US008217316B2

(12) United States Patent
Hansen et al.

(10) Patent No.: US 8,217,316 B2
(45) Date of Patent: Jul. 10, 2012

(54) MULTI-ZONE HEATING SYSTEM

(75) Inventors: William J. Hansen, Pewaukee, WI (US); Adam Van Essen, Menomonee Falls, WI (US); Terence T. Smith, Waukesha, WI (US); Praveen Rai, Menomonee Falls, WI (US)

(73) Assignee: Enthermics Medical Systems, Inc., Menomonee Falls, WI (US)

( * ) Notice: Subject to any disclaimer, the term of this patent is extended or adjusted under 35 U.S.C. 154(b) by 241 days.

(21) Appl. No.: 12/706,267

(22) Filed: Feb. 16, 2010

(65) Prior Publication Data

US 2011/0198338 A1 Aug. 18, 2011

(51) Int. Cl.
*F27D 11/00* (2006.01)
*A23C 3/02* (2006.01)

(52) U.S. Cl. ..... 219/406; 219/401; 219/400; 219/521; 219/202; 219/211; 99/483

(58) Field of Classification Search ..... 219/406, 219/401, 400, 521, 202, 211; 99/483
See application file for complete search history.

(56) References Cited

U.S. PATENT DOCUMENTS

| | | | | |
|---|---|---|---|---|
| 3,521,030 | A | 7/1970 | Maahs | |
| 3,800,123 | A | 3/1974 | Maahs | |
| 4,068,572 | A | 1/1978 | Vogt | |
| 5,408,576 | A | 4/1995 | Bishop | |
| 5,579,952 | A * | 12/1996 | Fiedler et al. | 221/150 A |
| 5,619,613 | A | 4/1997 | Otaki | |
| 6,121,583 | A | 9/2000 | Hansen | |
| 6,570,138 | B2 | 5/2003 | Hansen et al. | |
| 2006/0289000 | A1 | 12/2006 | Naylor | |
| 2008/0023462 | A1 | 1/2008 | Shei et al. | |

FOREIGN PATENT DOCUMENTS

| | | | |
|---|---|---|---|
| EP | 0715826 | A1 | 6/1996 |

OTHER PUBLICATIONS

International Search Report for PCT application (PCT/US2011/025006) based on continuation-in-part U.S. Appl. No. 13/018,524 of the subject application, mailed May 17, 2011.

* cited by examiner

*Primary Examiner* — Shawntina Fuqua
(74) *Attorney, Agent, or Firm* — Boyle Fredrickson, S.C.

(57) ABSTRACT

A heating system is disclosed including a cabinet having walls defining an interior heating chamber. Sensors are attached to an exterior surface of the walls. Heating pad subassemblies are attached to the exterior surface of the walls with each heating pad subassemblies located adjacent a corresponding sensor. The heating pad subassemblies include a pad having an attachment face coupled to the exterior surface of the walls and a heating element coupled to the pad. A controller is in electrical communication with the heating elements and the sensors. This controller is configured to independently monitor temperate measurements from each of the sensors and to independently control each of the heating elements. The heating pad subassemblies are positionable on the exterior side of the plurality of walls and the heating system compensates for load variations across the interior heating chamber.

11 Claims, 2 Drawing Sheets

MULTI-ZONE HEATING SYSTEM

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention is directed at a heating system. In particular, this invention is directed at a heating cabinet in which there are multiple heating zones.

Heating cabinets are frequently used to warm items and maintain the items at a desired temperature for a period of time. Conventionally, heating cabinets include an interior chamber which is accessible via a door. Internal heating elements warm the items inside the chamber. To best utilize the volume of the chamber, there are often shelves or other fixtures to accommodate placement of items vertically within the cabinet.

These warming cabinets are employed across a wide number of industries. For example, in the food service industry, once food has been prepared, the prepared food may need to be kept warm for a length of time before the food is served. Warming cabinets provide convenient, and frequently transportable, storage for the prepared food. As another example, in the medical industry, heating cabinets are frequently used to maintain intravenous fluids at or near body temperature to maintain the quality of the fluids and to prevent the receiving body from entering a thermal shock upon introduction of the fluid.

However, there are a number of challenges in making and using cabinets of this type. For one, when items are placed within the internal chamber, the cabinets may have an uneven item load. This can result in internal thermal gradients and uneven warming of the items in the cabinet. Additionally, production and/or maintenance of these cabinets may be time consuming or costly. Depending on the particular cabinet, specific parts may need to be stocked or ordered for different cabinet models.

Hence, a need exists for an improved heating cabinet with a flexible construction that is easily assembled.

SUMMARY OF THE INVENTION

The present invention provides a heating system with a flexible construction that is easily assembled. The disclosed heating system may be adapted to include a number of heating elements which may be attached at various locations around a cabinet. These heating elements are universally connectable to a controller which independently monitors the temperature of the wall corresponding to each of the heating elements and compensates for the load variations across the cabinet.

According to one aspect of the invention, a heating system includes a cabinet, sensors, heating pad subassemblies, and a controller. The cabinet has a plurality of walls defining an interior heating chamber. The sensors and heating pad subassemblies are attached to an exterior surface of the plurality of walls. Each of the heating pad subassemblies are located adjacent a corresponding sensor. The heating pad subassemblies include a pad having an attachment face coupled to the exterior surface of one of the walls of the cabinet and a heating element coupled to the pad. The controller is in electrical communication with the heating elements and the sensors. The controller is configured to independently monitor temperate measurements from each of the sensors and to independently control each of the heating elements. The plurality of heating pad subassemblies are positionable on the exterior side of the walls of the cabinet and the heating system compensates for load variations across the interior heating chamber.

The heating pad subassemblies may be adhesively attached to the exterior side of the walls of the cabinet. Further, mechanical means may also be used to attach the heating pad subassemblies to the exterior side of the walls of the cabinet.

Each of the heating pad subassemblies may include an electrical connector for connecting the heating pad subassemblies to the controller. The heating pad subassemblies may also include a circuit which allows the heating pad subassembly to operate on either 120 volt or 230 volt power.

Each of the sensors may include an electrical connector for connecting the sensors to the controller. The heating pad subassemblies may further include a sensor aperture formed through the pad adapted for placement over or around one of the sensors such that, when one of the heating pad subassemblies is placed over or around the sensor or a sensor bracket, the electrical connector for connecting the sensor to the controller remains exposed. The sensor may be coupled to the heating pad subassembly proximate a center of the attachment face of the heating pad subassembly such that a sensor bracket protrudes through the heating pad subassembly when the subassembly is attached to the wall.

Alternatively, the sensor may be embedded in the heating pad subassembly. With this construction, the sensor is automatically located relative to heating pad subassembly, regardless of the exact placement of the heating pad subassembly on the heating system. Although this construction may make it more difficult to access the sensor for repair, there may be cost savings associated with assembling the heating system when the sensor is embedded in the heating pad subassembly.

The heating element may be a thermal cable and/or may be electrically resistive.

The heating system may further include a shelf positioned in the interior heating chamber with a heating pad subassembly attached to the shelf. Each of the sensors may be attached to the exterior side of the walls via a bracket and a sensor aperture formed through the heating pad subassembly may be sized to match the bracket.

Thus, this invention allows for more flexible construction and easier assembly of heating systems. Depending on the size and configuration of the cabinet, the heating pad subassemblies may be placed at various locations on the cabinet. As these heating pad subassemblies, and their corresponding sensors, are independently controlled and monitored, regardless of the exact placement of the pads, the controller is capable of operating the heating system so as to reduce thermal gradients that result from uneven load distribution. Particularly, when the cabinet is made-to-order, this heating system accommodates various constructions with little or no modification to the basic heating components.

The disclosed heating system may also utilize common components across various models or sizes of cabinets, meaning that there is less need to have customized parts in the cabinet. For example, the same type of heating pad subassembly may be used in various sizes of cabinets (although larger volume cabinets may require more heating pad subassemblies to adequately heat the larger volume). Further, the controller may be configured to be operable in any of a number of different cabinets without the need to specifically program the controller based on the specifications of the heating cabinet. Programming controllers is a significant and time consuming part of construction and repair of heating systems.

These and still other advantages of the invention will be apparent from the detailed description and drawings. What follows is merely a description of a preferred embodiment of the present invention. To assess the full scope of the invention the claims should be looked to as the preferred embodiment are not intended to be the only embodiment within the scope of the claims.

DETAILED DESCRIPTION OF THE PREFERRED EMBODIMENT

Figure 1:
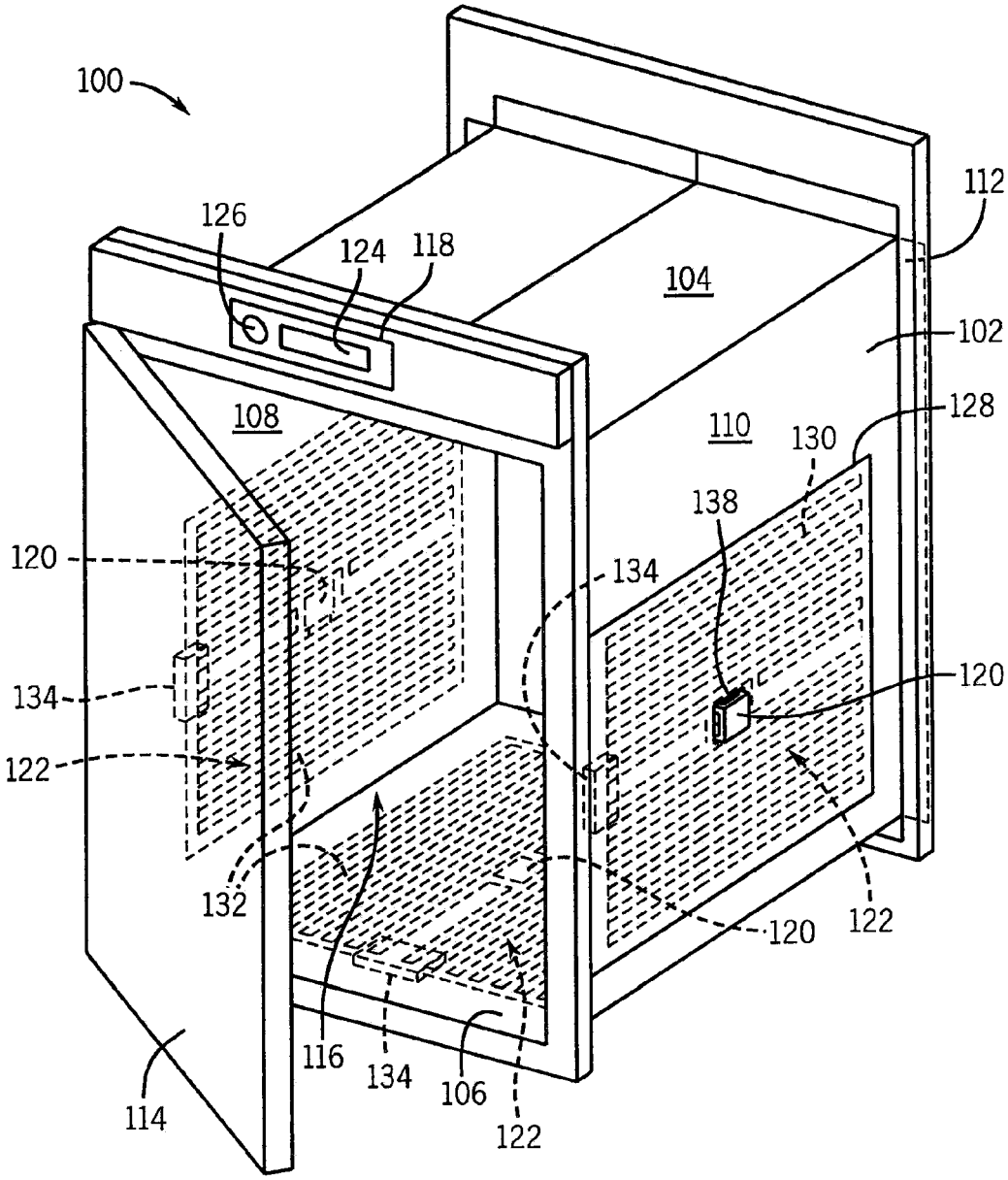
FIG. 1 a perspective view of a heating system.

Referring first to FIG. 1, a heating system 100 is shown. The heating system 100 may be used to warm items for a variety of applications. Some examples of items that may be heated include, but are not limited to, blankets, intravenous fluids, and food products.

The heating system 100 includes a cabinet 102 having a plurality of walls including a top wall 104, a bottom wall 106, a left wall 108, a right wall 110 and a rear wall 112. In the form shown, a door 114 is hingedly attached to the left wall 108. The door 114 may be opened to access the interior heating chamber 116 which is defined by the plurality of sidewalls and the door 114, when the door 114 is closed. There may be mechanisms that keep the door 114 closed such, for example, a biasing mechanism, a latch, or the like. This mechanism may assist in maintaining a seal (which may be a compressible gasket or the like) between the door 114 and the walls when the door 114 is closed.

In some forms, one or more shelves may be arranged in the interior heating chamber 116 to provide support for the items heated therein or to increase the capacity of the cabinet 102. One of the below-described heating pad subassemblies may be attached to the shelf to provide additional interior heating and to minimize any stratification in the cabinet 102. In other forms, support ledges may be affixed to the interior of the walls of the cabinet 102 for receiving insertable trays or the like.

Figure 2:
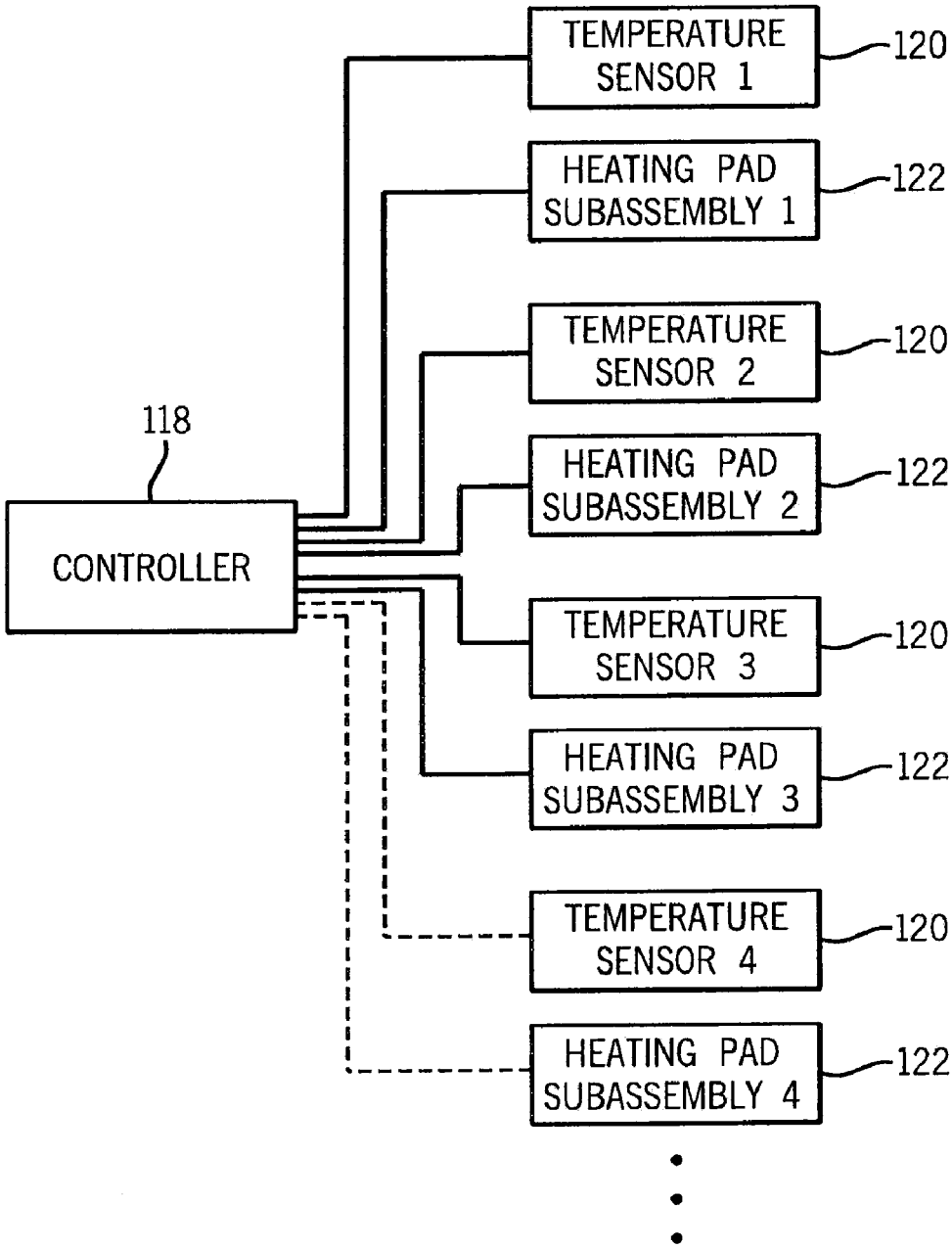
FIG. 2 is a schematic illustrating the connectivity of the various components of the heating system.

Now with additional reference to FIG. 2, the heating system 100 includes a controller 118 that is in electrical communication with a number of temperature sensors 120 and a corresponding number of heating pad subassemblies 122. The controller 118 is configured to independently monitor the temperature from each of the temperature sensors 120 and is further configured to independently control the heating element(s) in each of the heating pad subassemblies 122.

The controller 118 may include a number of ports for receiving connectors attached to electrical cables which connect to the temperature sensors 120 and their corresponding heating pad subassemblies 122. It is contemplated that the heating system 100, given its flexibility, may accommodate for various numbers of temperature sensors 120 and heating pad subassemblies 122 to satisfy the watt density requirements of the cabinet 102. For example, a cabinet of small volume may only need three heating pad subassemblies 122 to sufficiently warm the interior of the cabinet. However, a cabinet of larger volume may need more heating pad subassemblies 122 to maintain the temperature of the larger volume. Even in small cabinets, it may be preferable to include more heating pad subassemblies to provide a more even heating profile and/or minimize the load on the heating elements to improve their operating life. In any event, the controller 118 may have a number of ports for receiving temperature sensors 120 and/or heating pad subassemblies 122, but in the event that not all of the ports are occupied, then the controller 118 may be configured to operate using only the attached temperature sensors 120 and heating pad subassemblies 122.

To indicate that the controller 118 need not utilize all of the available ports, FIG. 2 includes dashed connections to indicate that some of these sensors 120 and heating pad subassemblies 122 may be omitted even if ports/connectors are available. Of course, the fact that three sets of solid lines indicate connections in FIG. 2 is intended to be illustrative, and in no way limiting.

It is contemplated that the specific connectivity of the controller 118 to the temperature sensors 120 and the heating pad subassemblies 122 may be direct or indirect. For example, given the power required to operate the heating pad subassemblies 122, the heating pad subassemblies 122 may be connected to a separate power supply (not shown) which is in separate communication with the controller 118. This power supply, at the instruction of the controller 118, may independently control the operation of the heating pad subassemblies 122.

The controller 118 may have a user interface including a display 124 and one or more controls 126. The display 124 may be used to show current operating conditions (i.e., the temperature of one or more of the heated zones) of the cabinet 102 or may be used in conjunction with the controls 126 to set a set point temperature of the interior heating chamber 116 or of the individual heating pad subassemblies 122.

In the form shown in FIG. 1, a number of heating pad subassemblies 122 are attached to the outside of the walls of the cabinet 102. As seen in FIG. 1, heating pad subassemblies 122 are attached to the left wall 108, the right wall 110, and the bottom wall 106. Given the tendency of the generated heat to rise, this placement may be beneficial as the heat produced proximate the bottom of the cabinet 102 will rise to the top, rather than be lost. However, the heating pad subassemblies 122 and their corresponding temperature sensors 120 may be differently located on the outside of the cabinet 102.

Each of the heating pad subassemblies 122 include both a pad 128 and a heating element 130 which is coupled to the pad 128. The heating element 130 may be placed between layers of the pad 128, or may be affixed to the a side of the pad 128. In some forms, the heating element 130 is an electrically resistive thermal cable which snakes though the pad 128. When a current is run through the thermally resistive heating element, the electrical resistance causes a controlled warming of the cable. In this form, the pad(s) 128 may be electrical insulators such that the current run through the heating element 130 alone. However, other types of heating elements 130 may be coupled to the pad(s) 128 instead of using a thermal cable such as, for example, a resistive film which has been etched to provide a pattern which carried in or by the pad 128.

The pad 128 has an attachment face 132 which is coupled to the exterior surface of one of the walls, or a interior shelf. The attachment face 132 may be attached to the exterior surface of one of the walls of the cabinet 102 in a number of ways. According to one preferred form, the attachment face 132 of the pad 128 is attached via an adhesive. The adhesive is selected such that, at the operational temperatures of the heating elements 130, the adhesive does not melt or degrade, causing the decoupling of the attachment face 132 of the pad 128 from the wall of the cabinet 102.

The attachment face 132 of the pad 128 may be coupled to the walls of the cabinet 102 in other ways either separately or in combination with adhesive attachment including, for example, mechanical fasteners. Mechanical fasteners may be deemed appropriate when the operational temperatures of the heating system 100 are sufficiently high to preclude the use of standard adhesives.

In the form shown, the heating pad subassembly 122 further contains a connector 134 which may be used to connect via an electrical cable the heating elements 130 of the pads 128 to an electrical source, such as a power source, which may be separate from or integrated into the controller 118.

The heating pad subassemblies 122 are modularly heated pads with circuits designed into them to accept 120 volt or 230 volt power. By including circuits that allow the heating pad subassemblies 122 to accept either type of power, this eases manufacturing requirements of the heating pads and provides manufacturers with the ability to quickly build units to various voltage requirements around the world with minimal change to production flow. During assembly, the heating pad subassemblies 122 are located and placed on the exterior walls of the cabinet 102 and then the power connections are attached to the connector 134 to electrically connect the heating pad subassembly 122 to the controller 118.

Proximate the center of the heating pad subassembly 122 there is an sensor aperture 136. As best seen in FIG. 1, a sensor bracket 138 is mounted to the exterior surface of the sidewalls of the cabinet 102 and, when the attachment face 132 of the heating pad subassembly 122 is attached to the exterior surface of the sidewall, the sensor aperture 136 is placed around the sensor bracket 138. This structure permits easy access to the sensor bracket 138 for installation of one of the temperature sensors 120, even when the heating pad subassembly 122 has already been coupled to the outside of the cabinet 102. Alternatively, an adhesive tape may be used to place the temperature sensors 120 on the wall. In many cases, using an adhesive tape to place the sensor may be preferable because of the reduced cost of tape and the minimal amount of time required to attached the sensor on the wall during assembly.

One of the temperature sensors 120 is received in the sensor bracket 138. As the sensor bracket 138 is centrally located with respect to the corresponding heating pad subassembly 122, the temperature sensor 120 will provide an accurate reading of the temperature of the adjacent wall. In some forms, the temperature sensor 120 may be received into an opening in the wall or be embedded in the wall to improve the accuracy of the reading. The sensor bracket 138 and temperature sensor 120 are placed against the wall prior to the attachment of the heating pad subassembly 122 such that when the heating pad subassembly 122 is attached to the outer surface of the wall, the sensor bracket 138 and temperature sensor 120 are trapped against the wall. This greatly reduces the assembly time of the heating system 100 and the parts needed for installation.

The controller 118 may be configured to sense whether an available connections has been made and make a determination automatically as whether to monitor or operate the particular connection. In this way the heat zones are established and operated by the connection of the sensors 120 and/or heating pad assemblies 122 to the cabinet 102. This design advantageously provides an even blanket of warmth independent of the load in the cabinet 102. For example, if the load to be warmed is shifted to the one side of the cabinet 102, then the loaded side will reach the set point and be maintained at the desired set point. Concurrently, the other side (which does not include the load) will separately be maintained at the desired set point by the controller 118. This configuration ensures that none of the surfaces exceed the desired set point temperature which may happen in some cabinets if all of the heating elements continue to run when even one of the elements is below the desired set point temperature.

The improved blanket of warmth also improves the safety of operation. The even heating ensures that one side is not likely to overheat in the interior heating chamber 116. Further, for heating of fluids where spoilage may occur above or below certain temperature limits, this even blanket of warmth helps to ensure that some of the fluids being warmed will not exit the acceptable temperature range.

The disclosed heating system also saves energy. As the controller 118 only independently controls the heating pad subassemblies to be operated when the independently monitored temperature sensors indicate that heating is necessary, only the heating pad subassemblies which need to be operated to warm a particular zone of the cabinet will be operated.

Accordingly, a heating system is disclosed which operates efficiently, is easy to assemble, and allows for flexibility of cabinet design with similar heating components. By providing a controller that independently monitors and controls various zones of the cabinet, an even blanket of warmth may be provided. This minimizes the energy use of the cabinet while still ensuring that the items contained in the cabinet are properly warmed.

Moreover, in a system including a number of attached heating pad subassemblies, when one of the subassemblies needs replacement, the other subassemblies are automatically configured to compensate until there is an opportunity to replace the worn out or damaged heating pad subassembly. Particularly when the heating system is in service and it would be inconvenient immediately repair or replace the out-of-service heating pad subassembly, this allows the system to continue to be used with little, if any impact on the performance of the heating system. Then, at a more preferable time, the heating system may be serviced.

It should be appreciated that various other modifications and variations to the preferred embodiment can be made within the spirit and scope of the invention. Therefore, the invention should not be limited to the described embodiment. To ascertain the full scope of the invention, the following claims should be referenced.

What is claimed is:

1. A heating system comprising:

a cabinet having at least two walls defining an interior heating chamber, wherein the at least two walls are respectively associated with at least two heating zones within the interior heating chamber;

at least two sensors attached to an surface of the walls and each positioned to monitor the temperature in different of the at least two heating zones;

at least two heating pad subassemblies attached to the exterior surface of the walls and positioned to generate heat in different of the at least two heating zones, each of the heating pad subassemblies surrounding a corresponding sensor and including:

a pad having an attachment face coupled to the exterior surface of the walls; and a heating element coupled to the pad; and a controller in electrical communication with the heating elements and the sensors, the controller configured to independently monitor the temperature from each of the sensors and further configured to independently control each of the heating elements;

wherein the heating pad subassemblies are positioned on the exterior side of the walls and the heating system compensates for loading variations in the interior heating chamber affecting heat transfer across the heating zones, within the interior heating chamber.

2. The heating system of claim 1, wherein the heating pad subassemblies are adhesively attached to the exterior side of the walls of the cabinet.

3. The heating system of claim 1, wherein the heating pad subassemblies include an electrical connector for connecting the heating pad subassemblies to the controller.

4. The heating system of claim 1, wherein the heating pad subassemblies include a circuit which allows the heating pad subassemblies to operate on 120 volt or 230 volt power.

5. The heating system of claim 1, wherein each of the sensors includes an electrical connector for connecting the sensors to the controller.

6. The heating system of claim 5, wherein the heating pad subassembly further includes a sensor aperture formed through the pad adapted for placement over one of the plurality of sensors such that, when one of the plurality of heating pad subassemblies is placed over the sensor, the electrical connector for connecting the sensor to the controller remains exposed.

7. The heating system of claim 1, wherein the heating element is a thermal heating pad system.

8. The heating system of claim 1, wherein the heating element is electrically resistive.

9. The heating system of claim 1, wherein the sensor is coupled to the heating pad subassembly proximate a center of the attachment face of the heating pad subassembly.

10. The heating system of claim 1, further comprising a shelf positioned in the interior heating chamber and a heating pad subassembly is attached to the shelf.

11. The heating system of claim 1, wherein a sensor is attached to the exterior side of the of walls via a bracket and wherein a sensor aperture formed through the heating pad subassembly is sized to match the bracket.

* * * * *